US006367125B1

(12) United States Patent
Lin

(10) Patent No.: US 6,367,125 B1
(45) Date of Patent: Apr. 9, 2002

(54) HANDLE ASSEMBLY PREVENTING A TOOL FROM SLIPPING

(75) Inventor: Chorng-Jiang Lin, Taichung (TW)

(73) Assignee: Chuck Cheng-Tsai Chang, Taichang (TW)

( * ) Notice: Subject to any disclaimer, the term of this patent is extended or adjusted under 35 U.S.C. 154(b) by 0 days.

(21) Appl. No.: 09/507,737

(22) Filed: Feb. 22, 2000

(51) Int. Cl.[7] ..... B25B 13/00
(52) U.S. Cl. ..... 16/436; 81/177.1
(58) Field of Search ..... 16/436, 421, 426, 16/422; 81/177.1, 489; 30/199, 340

(56) References Cited

U.S. PATENT DOCUMENTS 4,811,637 A * 3/1989 McCleary ..... 16/426
5,299,475 A * 4/1994 Stroop ..... 16/421
5,816,337 A * 10/1998 Kun-Chuan ..... 16/422
5,823,077 A * 10/1998 Macor ..... 81/177.1
5,852,960 A * 12/1998 Wu ..... 81/177.1
5,860,190 A * 1/1999 Cano ..... 16/422
5,911,798 A * 6/1999 Arnold ..... 81/177.1
5,950,280 A * 9/1999 Taylor ..... 16/422
6,029,315 A * 2/2000 Flower ..... 16/422
6,049,948 A * 4/2000 Leonardi ..... 16/422
6,089,130 A * 7/2000 Wu ..... 81/177.1

* cited by examiner

*Primary Examiner*—Lynne H. Browne
*Assistant Examiner*—Doug Hutton
(74) *Attorney, Agent, or Firm*—Rosenberg, Klein & Lee

(57) ABSTRACT

A handle assembly includes a handle body rotatably mounted on the shank of a tool, and a limiting device mounted in the handle body for use in limiting the amount of rotation between the handle body and the shank of the tool to a determined rotation angle so that the handle body rotated relative to the shank of the tool will not exceed a determined rotation angle, thereby preventing a user's hand from slipping from the handle body.

14 Claims, 14 Drawing Sheets

HANDLE ASSEMBLY PREVENTING A TOOL FROM SLIPPING

BACKGROUND OF THE INVENTION

1. Field of the Invention

The present invention relates to a handle assembly, and more particularly to a handle assembly that is used for preventing a tool from slipping in use.

2. Description of the Related Art

A conventional tool such as an open ended wrench in accordance with the prior art shown in FIG. 12 includes a shank 60 and a driving head 61 formed on one end of the shank 60 for operating a workpiece 62 such as a nut or the like. A user's hand 80 can hold the other end of the shank 60 so as to rotate the workpiece 62 by the driving head 61. However, during rotation of the shank 60, the user's hand 80 is inclined relative to the shank 60 so that the shank 60 is easily tilted by the user's hand 80. Accordingly, the driving head 61 is tilted by the shank 60 to deviate from the workpiece 62 so that the driving head 61 and the workpiece 62 are not in alignment with each other and so that the driving head 62 cannot optimally engage with the workpiece 62, thereby decreasing the performance of the driving head 61 on the workpiece 62, and thereby easily wearing the driving head 61 or the workpiece 62.

A first conventional handle for a tool such as an open ended wrench in accordance with the prior art shown in FIGS. 13 and 14 with reference to FIG. 12 includes two roller members 66 mounted on the shank 60 of the tool for increasing the mobility between the shank 60 of the tool and the user's hand 80. However, a torque "M" is created on the center of the shank 60 due to the force "F" being exerted by the user's hand 80 on the roller members 66 so that the driving head 61 is tilted by the shank 60 to deviate from the workpiece 62 so that the driving head 61 and the workpiece 62 are not in alignment with each other and so that the driving head 62 cannot optimally engage with the workpiece 62, thereby decreasing the performance of the driving head 61 on the workpiece 62.

A second conventional handle for a tool such as an open ended wrench in accordance with the prior art shown in FIGS. 15 and 16 includes a roller member 76 rotatably mounted on a cylindrical shank 70 of the tool for increasing the mobility between the shank 70 of the tool and the user's hand 80. However, the roller member 76 is freely rotated on the shank 70 of the tool without any limiting device for limiting the movement of the roller member 76. Accordingly, the user's hand 80 holding the roller member 76 tends to turn excessively relative to the shank 70 of the tool due to little friction between the roller member 76 and the shank 70 of the tool so that the user's hand 80 cannot efficiently grip or hold the shank 70 of the tool to operate a workpiece, thereby decreasing the performance of the driving head of the tool on the workpiece. In addition, the user's hand 80 cannot efficiently hold the shank 70 of the tool due to the roller member 76 being freely rotatable on the shank 70 of the tool so that the driving head of the tool cannot optimally engage with the workpiece, and easily slips on the workpiece which is easily detached from the driving head of the tool, thereby decreasing the performance of the driving head on the workpiece, and thereby easily wearing the driving head or the workpiece.

SUMMARY OF THE INVENTION

In accordance with one aspect of the present invention, there is provided a handle assembly for a shank of a tool comprising a handle body rotatably mounted on the shank of the tool, and a limiting device mounted in the handle body for use in limiting the amount of rotation between the handle body and the shank of the tool to a determined rotation angle.

The handle assembly further comprises a supporting barrel secured on the shank of the tool, wherein the handle body is rotatably mounted on the supporting barrel, and the limiting device is mounted between the supporting barrel and the handle body. The limiting device includes a curved limiting groove defined in an outer wall of the supporting barrel, and a limiting member mounted on an inner wall of the handle body and slidably received in the curved limiting groove.

The handle assembly further comprises a restoring device mounted between the supporting barrel and the handle body and including a restoring spring mounted on the supporting barrel and located in the handle body. The restoring spring has a first end secured to the supporting barrel and a second end secured to the handle body. The restoring device also includes an annular first receiving groove defined in an outer wall of the supporting barrel for receiving the restoring spring, and an annular second receiving groove defined in an inner wall of the handle body for receiving the restoring spring.

The handle assembly further comprises an alignment device mounted between the supporting barrel and the handle body and including a guide groove defined in an outer wall of the supporting barrel, a retaining notch defined in a mediate portion of the guide groove, a retaining recess defined in an inner wall of the handle body, and a flexible alignment member secured in the retaining recess. The alignment member is slidably received in the guide groove to be detachably received in the retaining notch.

The handle body includes a first half body and a second half body securely coupled with each other. The second half body has a plurality of locking bores defined therein, and the first half body includes a plurality of snapping stubs each snapped into a corresponding one of the locking bores for coupling the first half body with the second half body.

Further benefits and advantages of the present invention will become apparent after a careful reading of the detailed description with appropriate reference to the accompanying drawings.

DETAILED DESCRIPTION OF THE INVENTION

Figure 1:
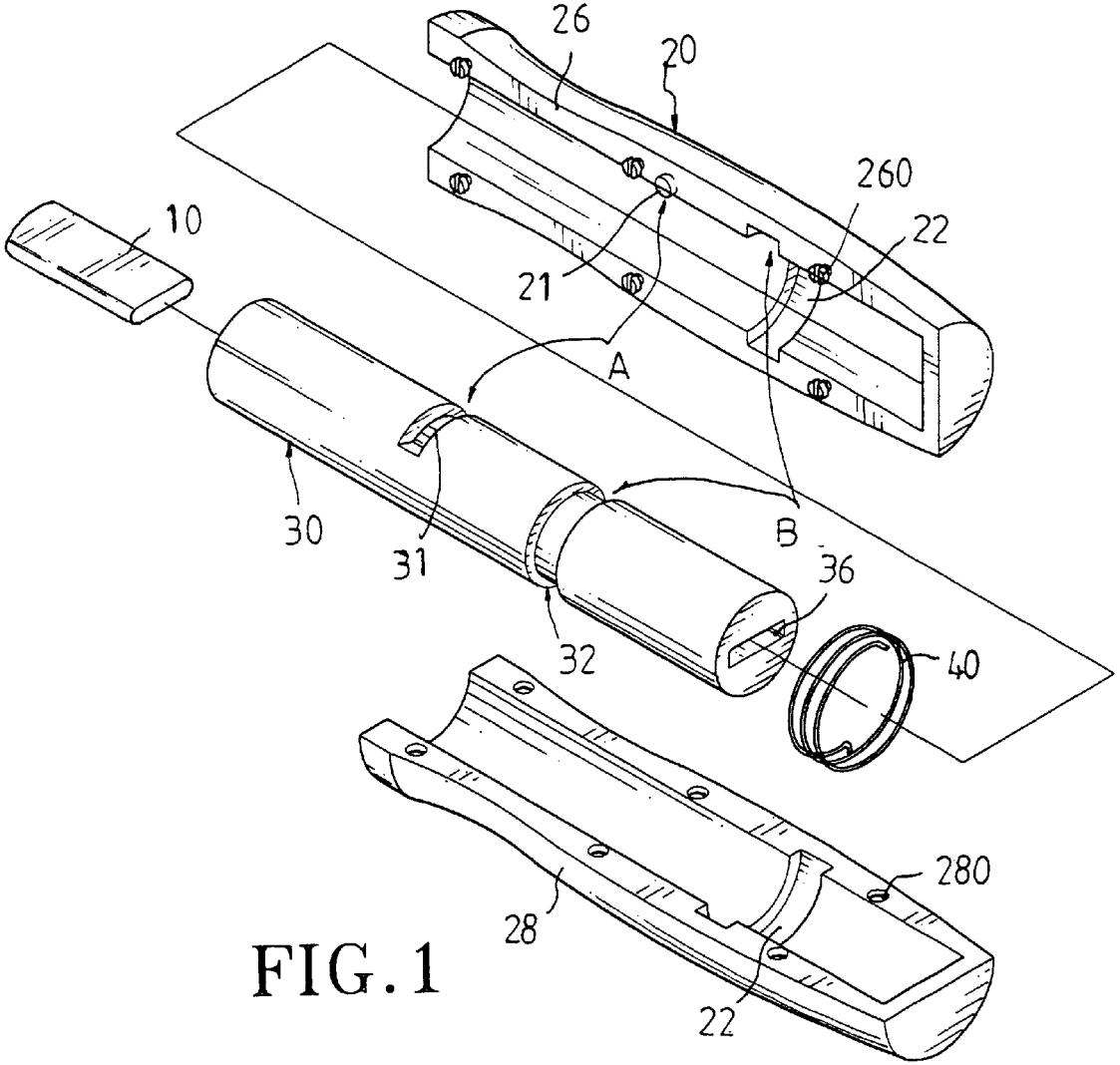
FIG. 1 is an exploded perspective view of a handle assembly for a tool in accordance with the present invention.
Figure 2:
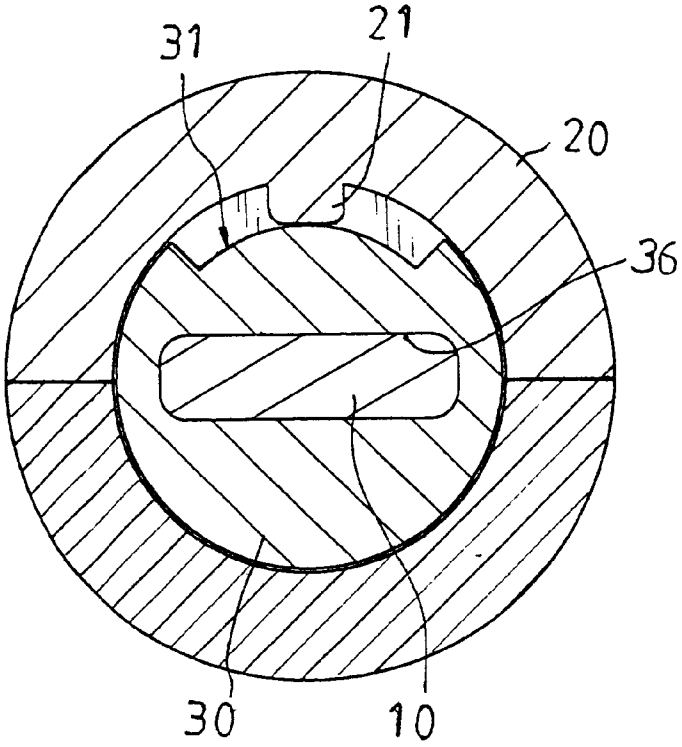
FIG. 2 is a side plan cross-sectional assembly view of the handle assembly as shown in FIG. 1.
Figure 3:
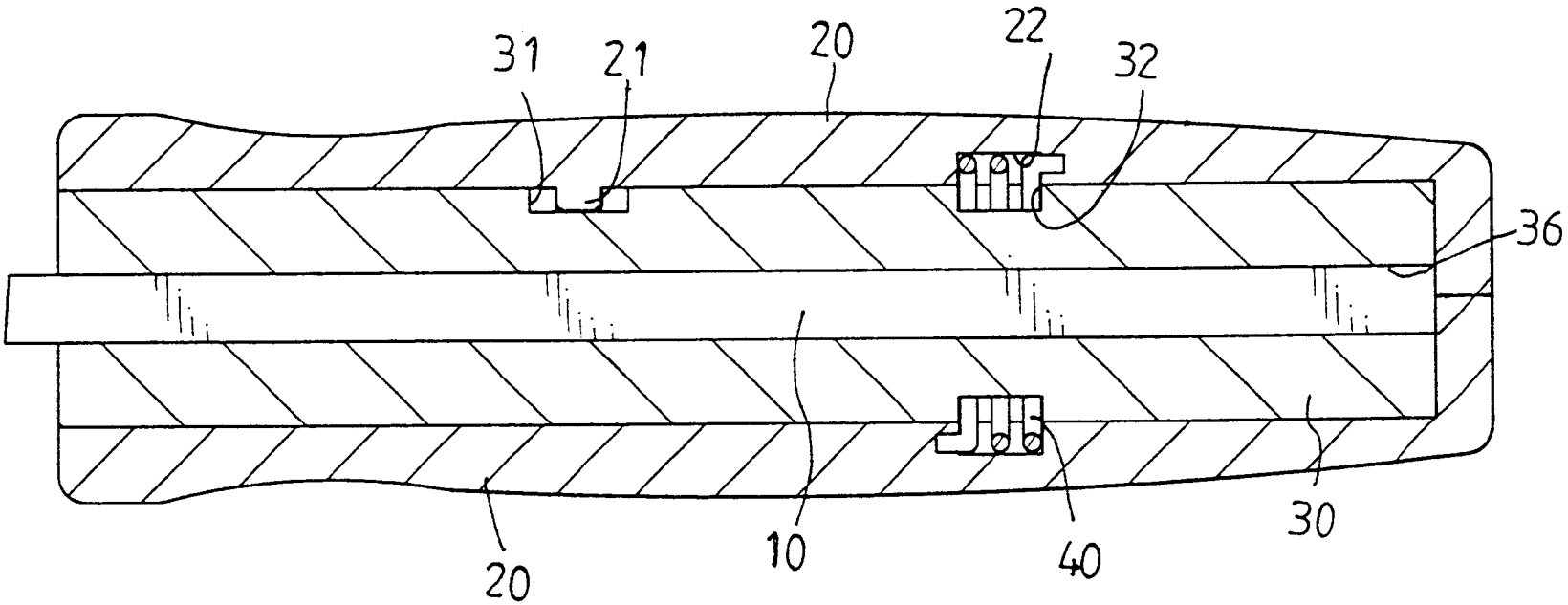
FIG. 3 is a front plan cross-sectional assembly view of the handle assembly as shown in FIG. 1.
Figure 11:
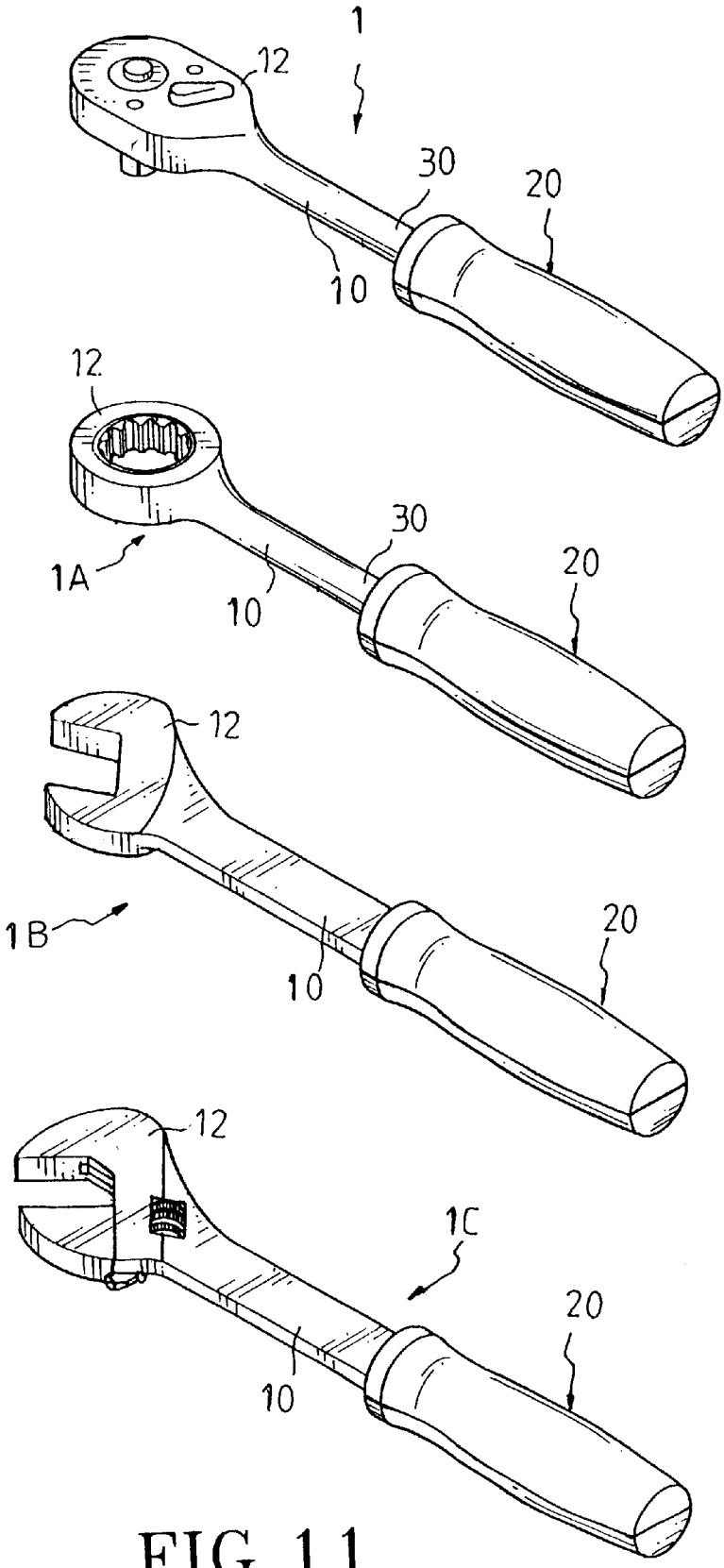
FIG. 11 is a perspective view of a number of tools in accordance with the present invention.
Figure 12:
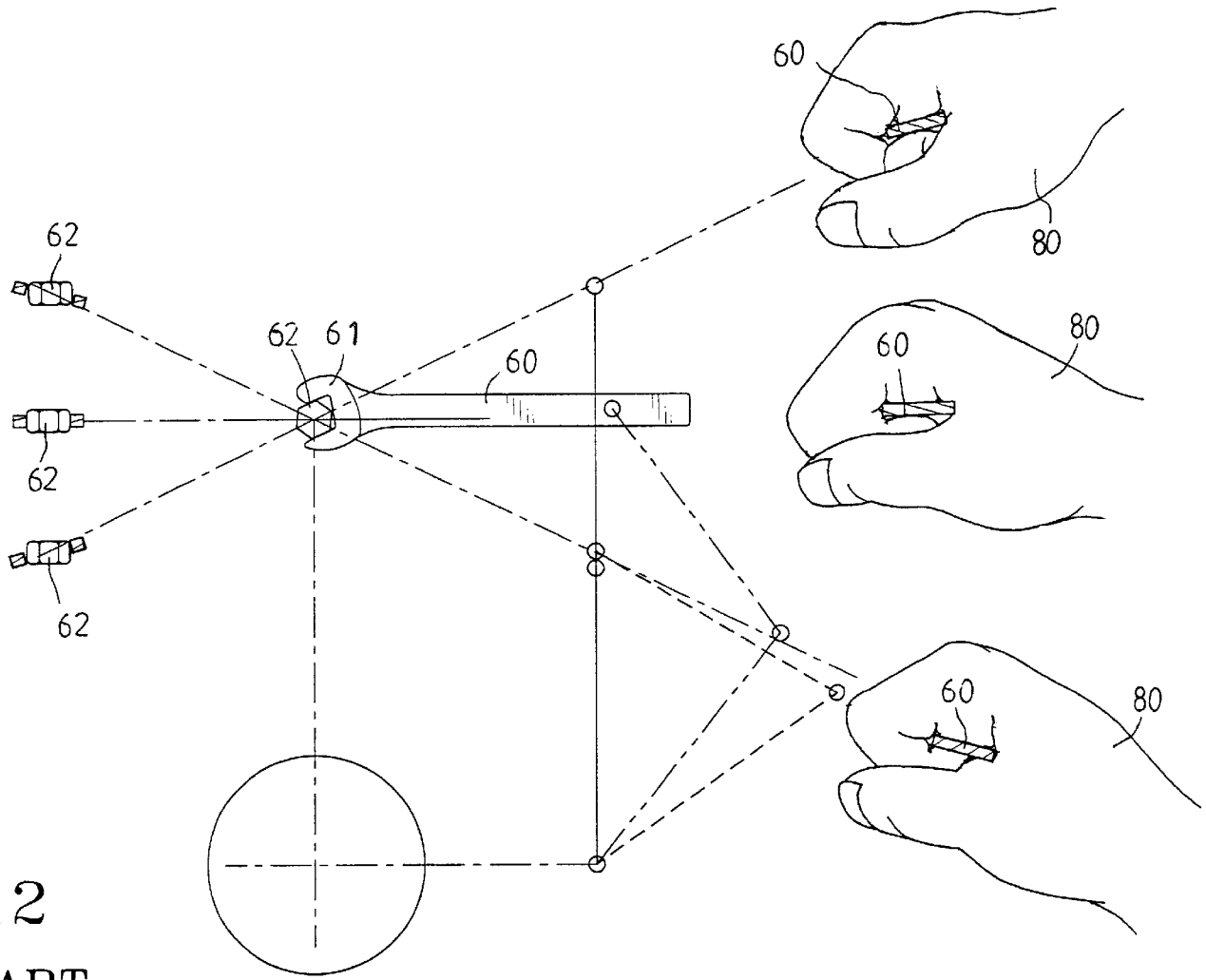
FIG. 12 PRIOR ART
FIG. 12 is a schematic view of a conventional tool in accordance with the prior art.
Figure 13:
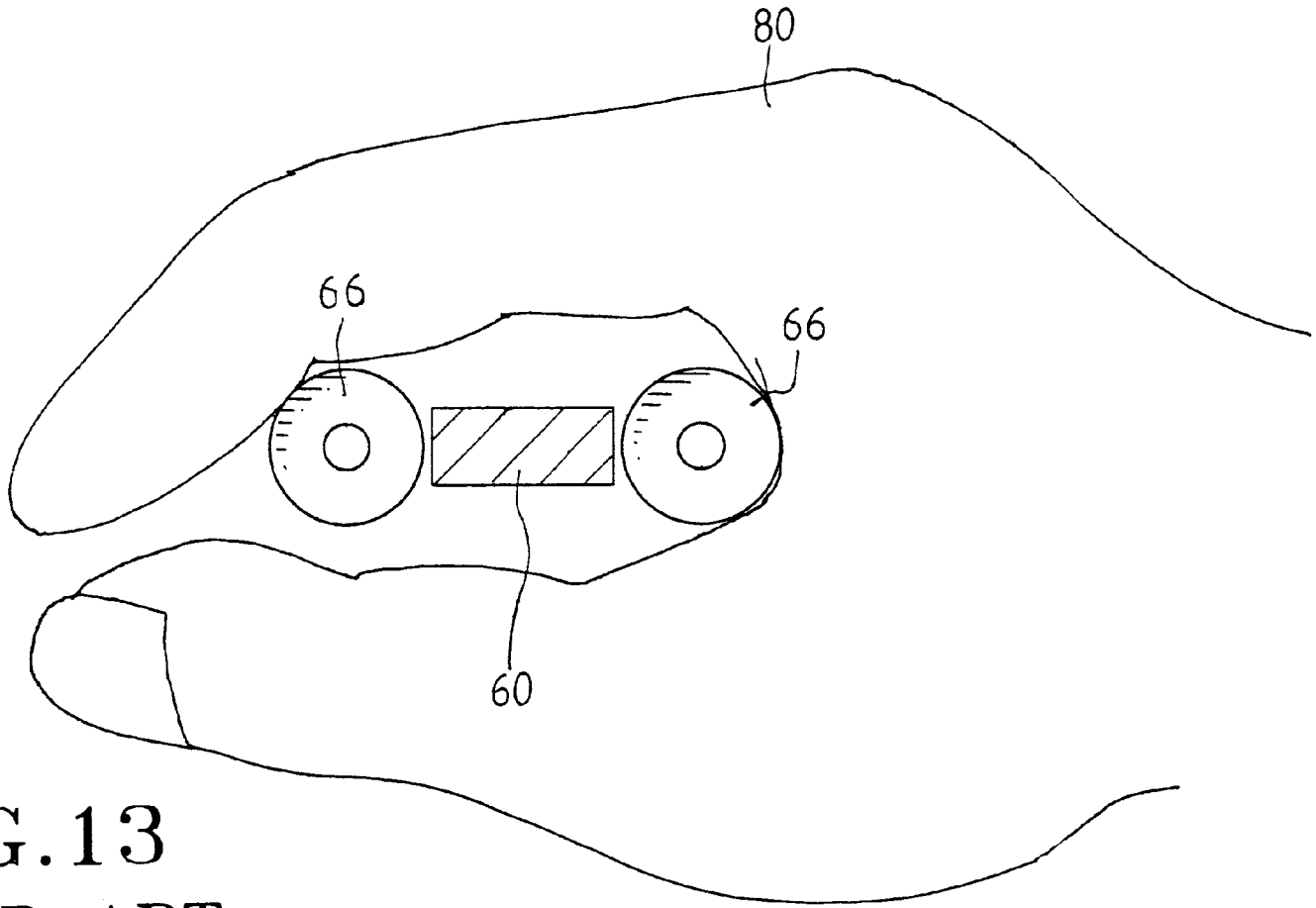
FIG. 13 PRIOR ART
FIG. 13 is a side plan cross-sectional schematic view of a first conventional handle for a tool in accordance with the prior art.
Figure 14:
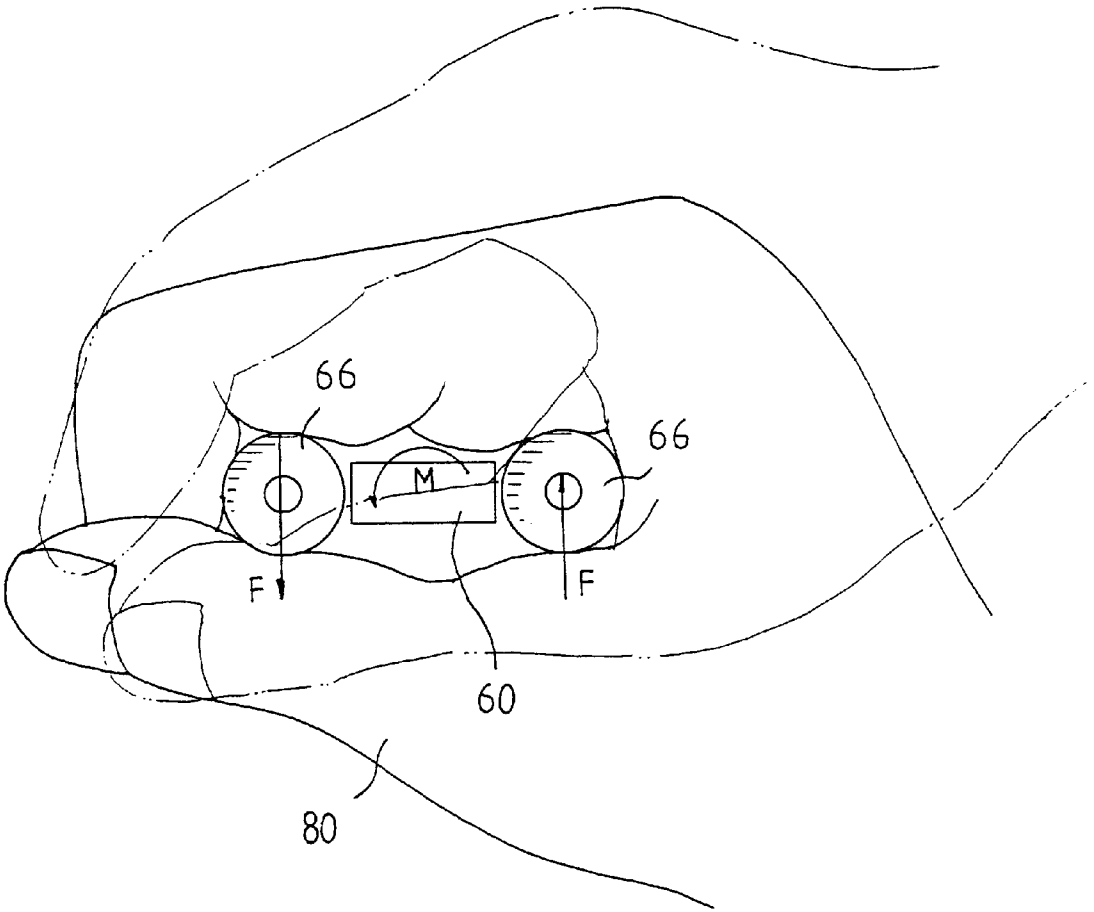
FIG. 14 PRIOR ART
FIG. 14 is an operational view of the conventional handle as shown in FIG. 13.
Figure 15:
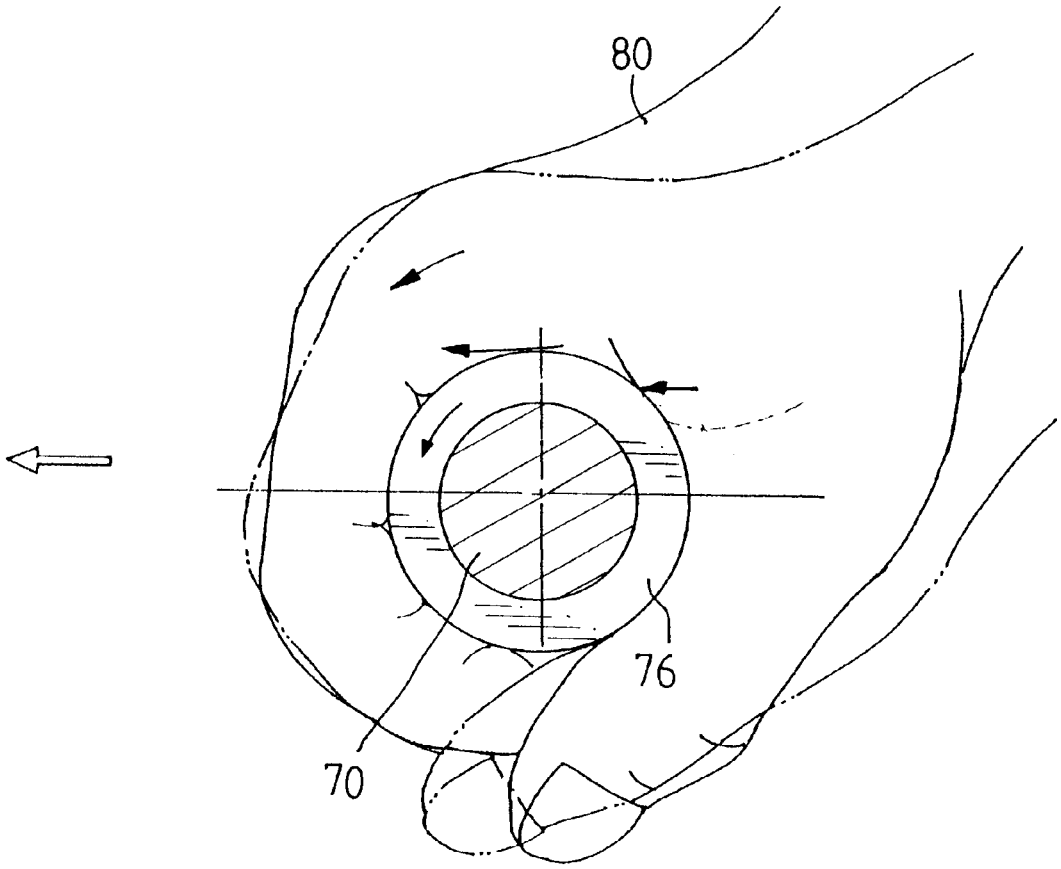
FIG. 15 PRIOR ART
FIG. 15 is a side plan schematic view of a second conventional handle for a tool in accordance with the prior art.
Figure 16:
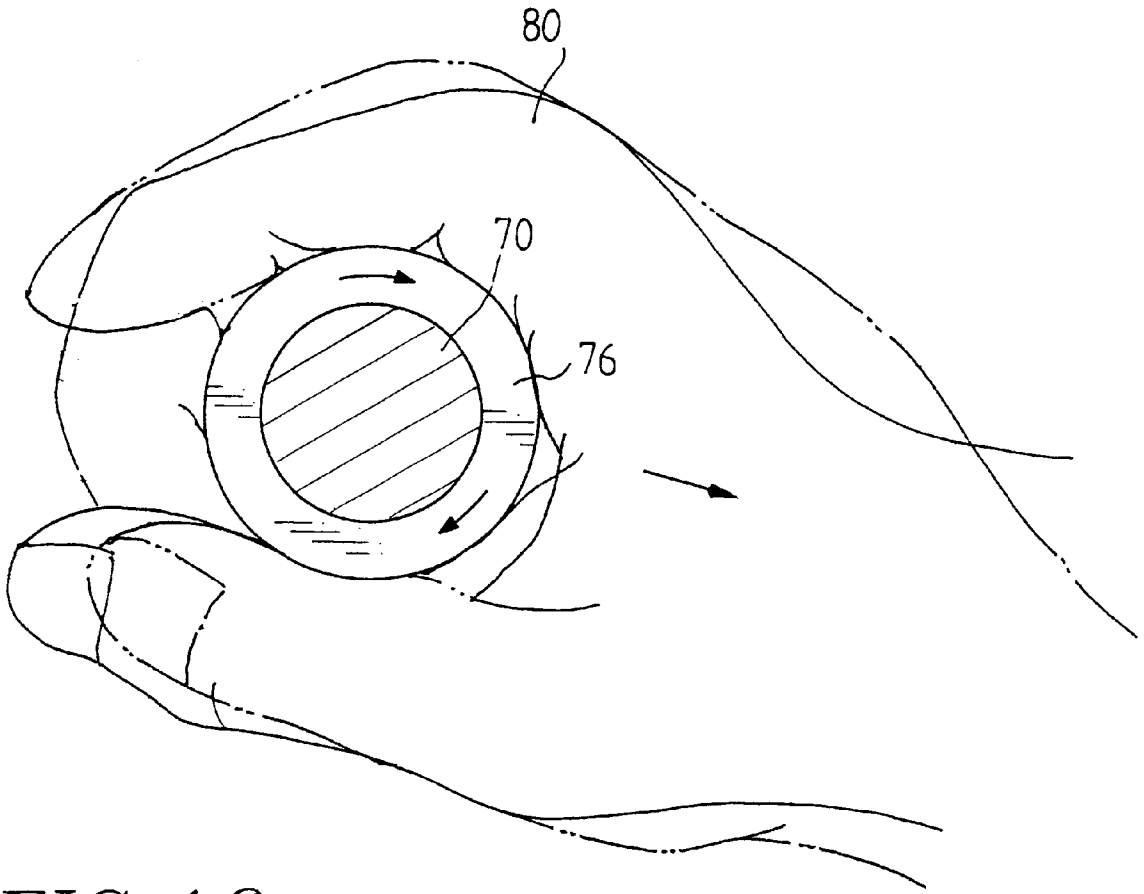
FIG. 16 PRIOR ART
FIG. 16 is an operational view of the conventional handle as shown in FIG. 15.

Referring to the drawings and initially to FIGS. 1–3 with reference to FIG. 11, a handle assembly in accordance with the present invention is adapted to be fitted on a shank 10 of a tool such as a socket wrench 1, a ratchet wrench 1A, an open ended wrench 1B or a movable wrench 1C. The tools 1, 1A, 1B or 1C each include a driving head 12 formed on one end of the shank 10 for driving a workpiece (not shown) such as a nut, a bolt or the like.

The handle assembly essentially comprises a handle body 20 rotatably mounted on the shank 10 of the tool, and a limiting device "A" mounted in the handle body 20 for use in limiting the amount of rotation between the handle body 20 and the shank 10 of the tool to a determined rotation angle.

The handle assembly further comprises a supporting barrel 30 secured on the shank 10 of the tool, wherein the handle body 20 is rotatably mounted on the supporting barrel 30, and the limiting device "A" is mounted between the supporting barrel 30 and the handle body 20. The shank 10 of the tool has a rectangular shape, and the supporting barrel 30 defines a rectangular hole 36 for receiving the shank 10 of the tool therein.

The limiting device "A" includes a curved limiting groove 31 defined in an outer wall of the supporting barrel 30, and a limiting member 21 mounted on an inner wall of the handle body 20 and slidably received in the curved limiting groove 31.

Preferably, the limiting member 21 is a lug integrally formed on the inner wall of the handle body 20 and slidably received in the curved limiting groove 31. Alternatively, the limiting member 21 is a bolt or a screw (not shown) extending through the wall of the handle body 20 and slidably received in the curved limiting groove 31.

The handle assembly further comprises a restoring device "B" mounted between the supporting barrel 30 and the handle body 20 including a restoring spring 40 mounted on the supporting barrel 30 and located in the handle body 20. The restoring spring 40 has a first end secured to the supporting barrel 30 and a second end secured to the handle body 20. The restoring device "B" further includes an annular first receiving groove 32 defined in the outer wall of the supporting barrel 30 for receiving the restoring spring 40, and an annular second receiving groove 22 defined in the inner wall of the handle body 20 for receiving the restoring spring 40.

In assembly, the handle body 20 can be integrally formed with a cylindrical shape. Alternatively, the handle body 20 includes a first half body 26 and a second half body 28 securely coupled with each other. The first half body 26 and the second half body 28 are coupled with each other by means of a high frequency wave process. Alternatively, as shown in FIG. 1, the second half body 28 has a plurality of locking bores 280 defined therein, and the first half body 26 includes a plurality of snapping stubs 260 each snapped into a corresponding one of the locking bores 280 for coupling the first half body 26 with the second half body 28.

Figure 4:
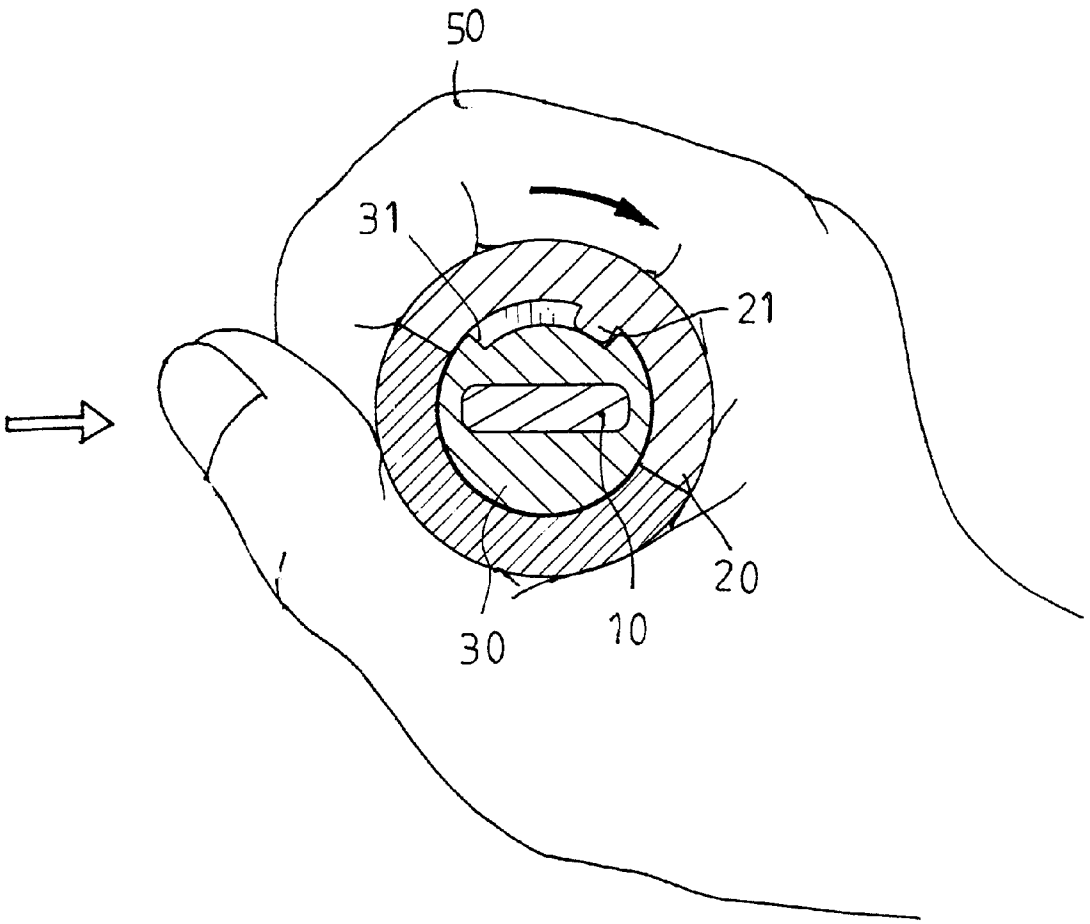
FIG. 4 is an operational view of the handle assembly as shown in FIG. 2.
Figure 5:
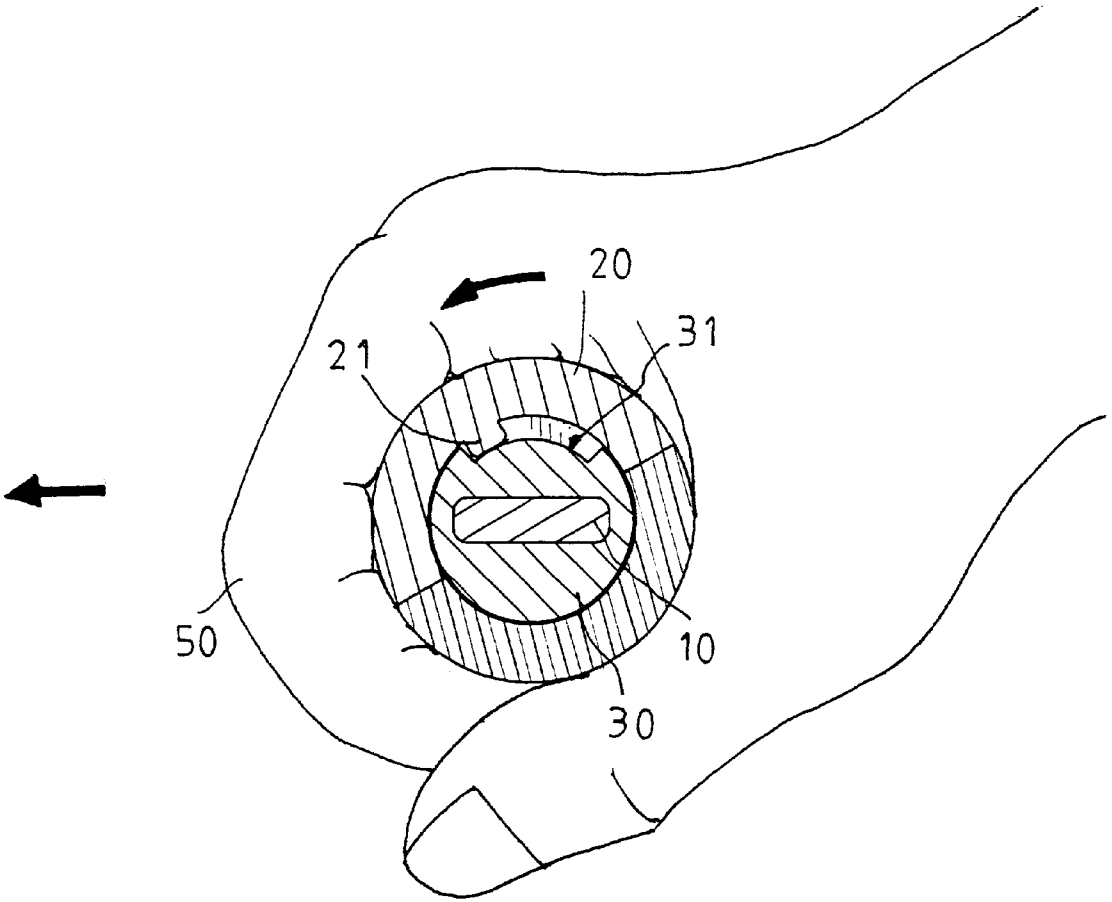
FIG. 5 is an operational view of the handle assembly as shown in FIG. 2.

In operation, referring to FIGS. 4 and 5 with reference to FIGS. 1–3, a user's hand 50 can exert torque on the handle body 20 to rotate the handle body 20 relative to the supporting barrel 30 so that the limiting member 21 can be moved in the curved limiting groove 31 from the position as shown in FIG. 2 to the position as shown in FIG. 4 or to the position as shown in FIG. 5. Accordingly, the limiting member 21 is limited to move in the curved limiting groove 31 between the position as shown in FIG. 4 and the position as shown in FIG. 5 so that the handle body 20 is limited to rotate on the supporting barrel 30 around a determined and limited rotation angle, thereby preventing the handle body 20 from rotating excessively.

In such a manner, the handle body 20 can be properly rotated relative to the shank 10 of the tool so as to eliminate the difference of angle defined between the user's hand 50 and the shank 10 of the tool so that the driving head 12 (FIG. 11) of the tool and the workpiece (not shown) can be constantly maintained in a horizontal status with each other, thereby optimally operating the workpiece by the driving head 12 of the tool.

In addition, the handle body 20 is limited to rotate on the supporting barrel 30 around a limited rotation angle so that the handle body 20 will not rotate excessively relative to the supporting barrel 30, and will be stopped by the wall of the curved limiting groove 31 of the supporting barrel 30 so as to provide a friction effect between the user's hand 50 and the handle body 20 so that the user's hand 50 can hold the handle body 20 to operate the workpiece without slipping.

Figure 6:
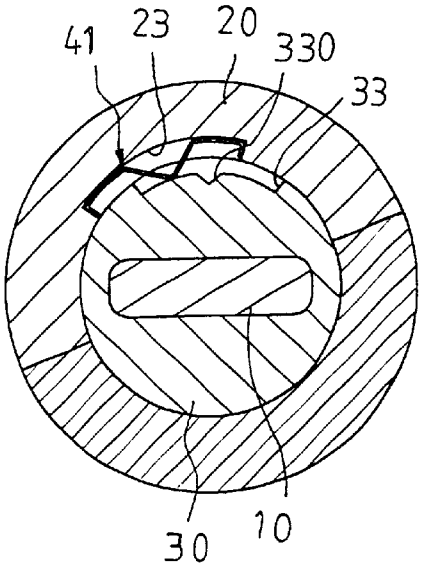
FIG. 6 is a side plan cross-sectional assembly view of the handle assembly in accordance with another embodiment of the present invention.
Figure 7:
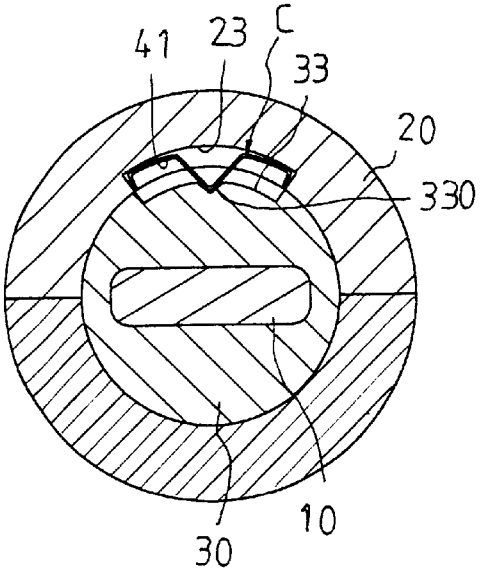
FIG. 7 is an operational view of the handle assembly as shown in FIG. 6.

Referring to FIGS. 6 and 7, in accordance with another embodiment of the present invention, the handle assembly further comprises an alignment device "C" mounted between the supporting barrel 30 and the handle body 20 and including a guide groove 33 defined in the outer wall of the supporting barrel 30, a retaining notch 330 defined in a mediate portion of the guide groove 33, a retaining recess 23 defined in the inner wall of the handle body 20, and a flexible alignment member 41 secured in the retaining recess 23. The alignment member 41 is slidably received in the guide groove 33 to be detachably received in the retaining notch 330.

In operation, when the handle body 20 is rotated on the supporting barrel 30, the alignment member 41 is initially detached from the retaining notch 330 as shown in FIG. 6. When the torque exerted on the handle body 20 by the user's hand 50 is removed, the handle body 20 is returned to its original position by means of the restoring force exerted by the restoring spring 40 of the restoring device "B" so that the alignment member 41 guide groove 33 to be finally received into the retaining notch 330 as shown in FIG. 7, thereby securing the handle body 20 on the supporting barrel 30.

Figure 8:
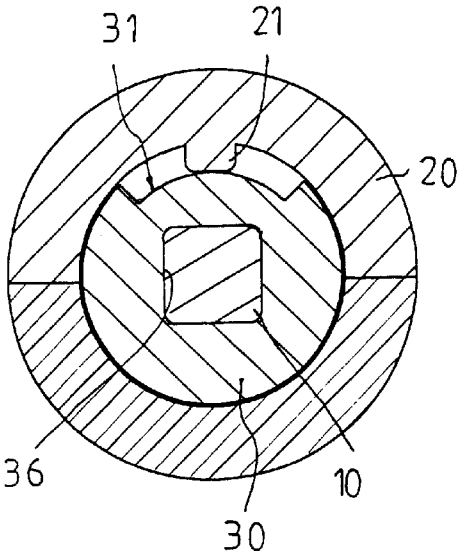
FIG. 8 is a side plan cross-sectional assembly view of the handle assembly in accordance with a further embodiment of the present invention.

Referring to FIG. 8, in accordance with a further embodiment of the present invention, the shank 10 of the tool has a square shape, and the supporting barrel 30 defines a square hole 36 for receiving the shank 10 of the tool.

Figure 9:
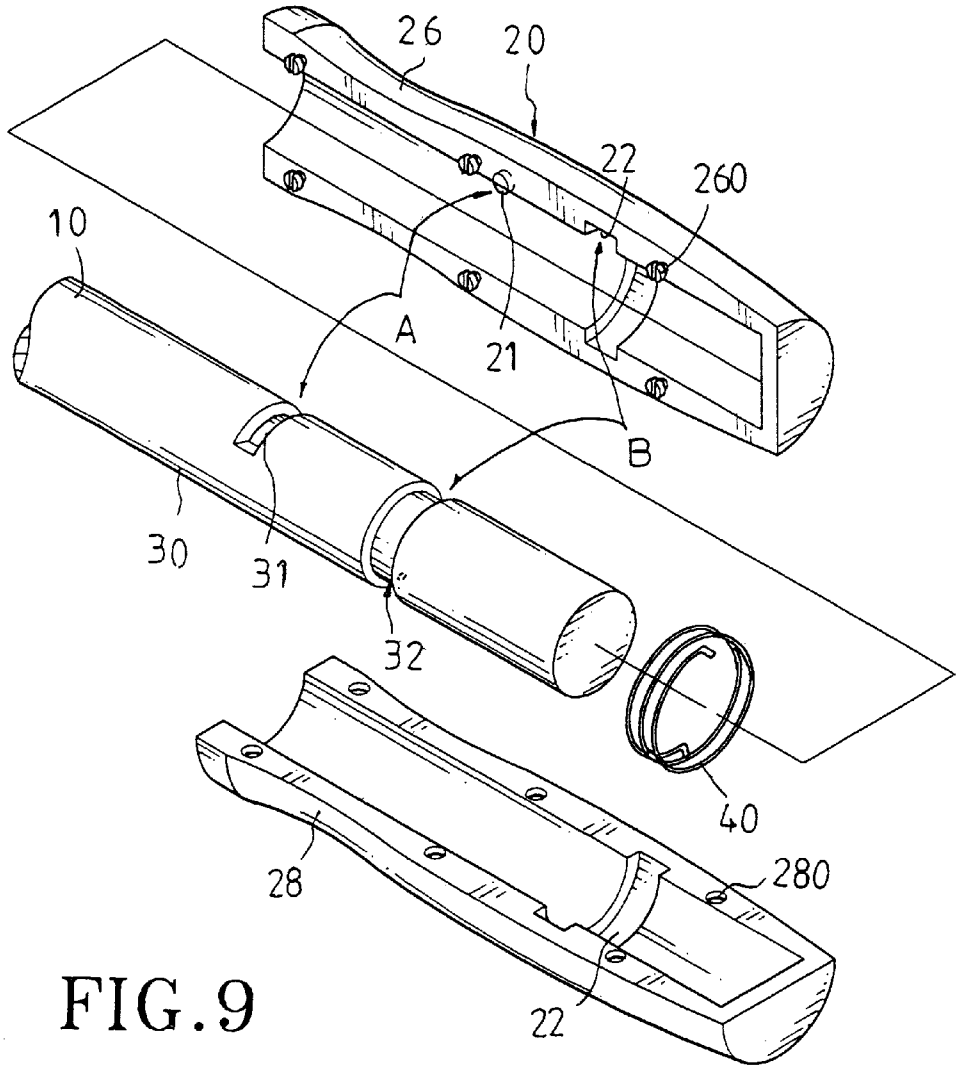
FIG. 9 is an exploded perspective view of a handle assembly for a tool in accordance with a further embodiment of the present invention.
Figure 10:
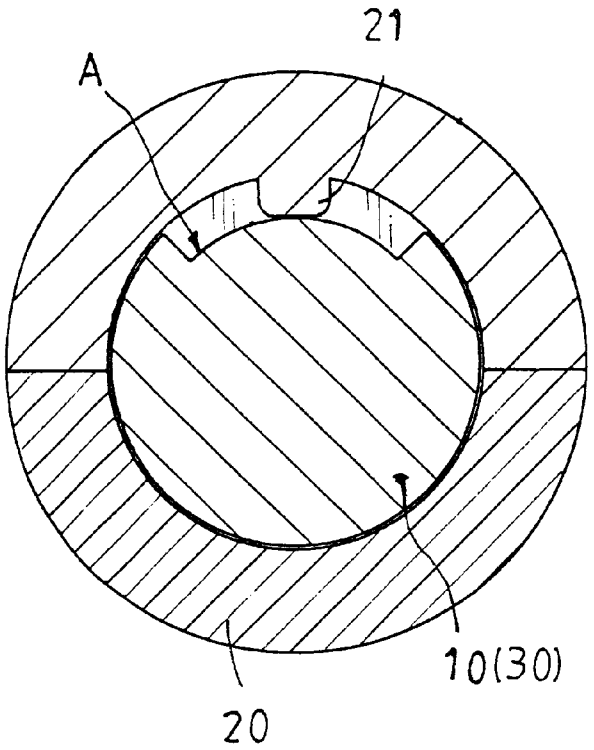
FIG. 10 is a side plan cross-sectional assembly view of the handle assembly as shown in FIG. 9.

Referring to FIGS. 9–11, in accordance with a further embodiment of the present invention, the shank 10 of the tool can be formed with a cylindrical shape to be integrally formed with the cylindrical shaped supporting barrel 30.

It should be clear to those skilled in the art that further embodiments may be made without departing from the scope of the present invention.

What is claimed is:

1. A handle assembly for a shank (10) of a tool comprising:

a supporting barrel (30) secured on said shank (10) of said tool;

a handle body (20) rotatably mounted on said supporting barrel (30); and, a limiting device (A) mounted between said supporting barrel (30) and said handle body (20) for use in limiting an amount of rotation between said handle body and said supporting barrel to a determined rotation angle.

2. The handle assembly in accordance with claim 1, wherein said limiting device (A) includes a curved limiting groove (31) defined in an outer wall of said supporting barrel (30), and a limiting member (21) mounted on an inner wall of said handle body (20) and slidably received in said curved limiting groove.

3. The handle assembly in accordance with claim 2, wherein said limiting member (21) is a lug integrally formed on the inner wall of said handle body (20).

4. The handle assembly in accordance with claim 1, further comprising a restoring device (B) mounted between said supporting barrel (30) and said handle body (20) and including and a restoring spring (40) mounted on said supporting barrel (30) and located in said handle body (20), wherein said restoring spring (40) has a first end secured to said supporting barrel (30) and a second end secured to said handle body (20).

5. The handle assembly in accordance with claim 4, wherein said restoring device (B) further includes an annular receiving groove (32) defined in an outer wall of said supporting barrel (30) for receiving said restoring spring (40).

6. The handle assembly in accordance with claim 4, wherein said restoring device (B) further includes an annular receiving groove (22) defined in an inner wall of said handle body (20) for receiving said restoring spring (40).

7. The handle assembly in accordance with claim 1, further comprising an alignment device (C) mounted between said supporting barrel (30) and said handle body (20) and including a guide groove (33) defined in an outer wall of said supporting barrel (30), a retaining notch (330) defined in a mediate portion of said guide groove (33), a retaining recess (23) defined in an inner wall of said handle body (20), and a flexible alignment member (41) secured in said retaining recess (23), wherein said alignment member (41) is slidably received in said guide groove (33) to be detachably received in said retaining notch (330).

8. The handle assembly in accordance with claim 1, wherein said shank (10) of said tool has a rectangular shape, and said supporting barrel (30) defines a rectangular hole (36) for receiving said shank (10) of said tool.

9. The handle assembly in accordance with claim 1, wherein said shank (10) of said tool has a square shape, and said supporting barrel (30) defines a square hole (36) for receiving said shank (10) of said tool.

10. The handle assembly in accordance with claim 1, wherein said shank (10) of said tool is integrally formed with said supporting barrel (30).

11. The handle assembly in accordance with claim 10, wherein said shank (10) of said tool has a cylindrical shape.

12. The handle assembly in accordance with claim 1, wherein said handle body (20) is integrally formed with a cylindrical shape.

13. The handle assembly in accordance with claim 1, wherein said handle body (20) includes a first half body (26) and a second half body (28) securely coupled with each other.

14. The handle assembly in accordance with claim 13, wherein said second half body (28) has a plurality of locking bores (280) defined therein, and said first half body (26) includes a plurality of snapping stubs (260) each snapped into a corresponding one of said locking bores (280) for coupling said first half body (26) with said second half body (28).

* * * * *